United States Patent [19]

Nilsson

[11] Patent Number: 4,714,870

[45] Date of Patent: Dec. 22, 1987

[54] ARRANGEMENT FOR CONTROLLING AN A.C. VOLTAGE

[75] Inventor: Alf B. Nilsson, Malmö, Sweden

[73] Assignee: Aktiebolaget Electrolux, Sweden

[21] Appl. No.: 922,337

[22] Filed: Oct. 23, 1986

[30] Foreign Application Priority Data

Nov. 7, 1985 [SE] Sweden ..... 8505272

[51] Int. Cl.[4] ..... G05F 1/20

[52] U.S. Cl. ..... 323/258; 323/301; 323/343

[58] Field of Search ..... 323/235, 255, 258–259, 323/263, 301, 319, 340, 343–344, 901

[56] References Cited

U.S. PATENT DOCUMENTS 3,619,765 11/1971 Wood ..... 323/258
3,921,059 11/1975 Birman et al. ..... 323/258 X
4,623,834 11/1986 Klingbiel et al. ..... 323/258

FOREIGN PATENT DOCUMENTS 2077964 12/1981 United Kingdom ..... 323/258

*Primary Examiner*—Peter S. Wong
*Attorney, Agent, or Firm*—Alfred E. Miller

[57] ABSTRACT

An arrangement for controlling an A.C. voltage supplied to a load, such as a fluorescent lamp emitting germicidal ultraviolet radiation in a water-purifying apparatus. The load is connected to the secondary winding of a transformer, the primary winding of which has a number of taps which are selectively connectable to an exterior A.C. voltage source. An electronic control device is arranged in dependence on the magnitude of the terminal voltage of the exterior A.C. voltage source to automatically connect that tap which causes the voltage applied to the load to be of a predetermined value.

4 Claims, 2 Drawing Figures

ARRANGEMENT FOR CONTROLLING AN A.C. VOLTAGE

The present invention relates to an arrangement for controlling an A.C. voltage supplied to a load. The load may be a fluorescent lamp emitting germicidal ultraviolet radiation in a water-purifying apparatus.

In an apparatus of the kind referred to, in order for the germicidal effect to be optimum, it is very important for the ultraviolet radiation to have the proper wavelength and intensity. The radiation intensity is determined by the current flowing through the fluorescent lamp and, therefore, this current must not vary to any great extent. A variation greater than ±10% cannot be accepted. The fluorescent lamp has qualities such that the tolerance level of the current is also valid for the voltage applied.

For example, a fluorescent lamp of the kind indicated is operated at 110 V AC and, accordingly, this voltage is not allowed to vary more than ±10%. In different countries there are electric distribution systems having different system voltages, for example 110 V or 220–240 V. Moreover, in many countries where water-purifying apparatus are used the system voltage varies considerably due to weak distribution networks. It is true that those apparatus hitherto on the market have been reconnectible between different fixed system voltages, however, it has not been possible to take into consideration variations in the nominal value of the system voltages. As a result the purifying effect of the apparatus has deteriorated or even been entirely lost.

An arrangement being suitable for the object indicated above is described in IBM Technical Disclosure Bulletin, Vol. 27, No. 5, October 1984, pages 3134–3136. The arrangement described is a power supply in which the output voltage remains constant independent of variations in the input voltage. The arrangement comprises a transformer having a secondary winding and a primary winding with a number of taps. A load is connected to the secondary winding and electronic switches are provided to selectively connect the taps of the primary winding to the mains voltage to supply the correct voltage to the load. The different taps are connected in a stepwise manner and when the different taps are switched transients will occur which may destroy the switches. A solution to the problem is to provide protective circuits, so-called snubbers, for the switches.

The primary object of the invention is to remedy the drawback indicated and to provide a control arrangement for a lamp of the kind referred to which when used in a water-purifying apparatus will make possible an automatic reconnection between different system voltages and also that for a given system voltage the voltage applied to the lamp will be kept constant within the desired limits.

The secondary object of the invention is to prevent the generation of transients in an arrangement of the kind referred to in connection with the switching of the electronic switches.

The invention will now be described in detail with reference to the enclosed drawings.

Figure 1:
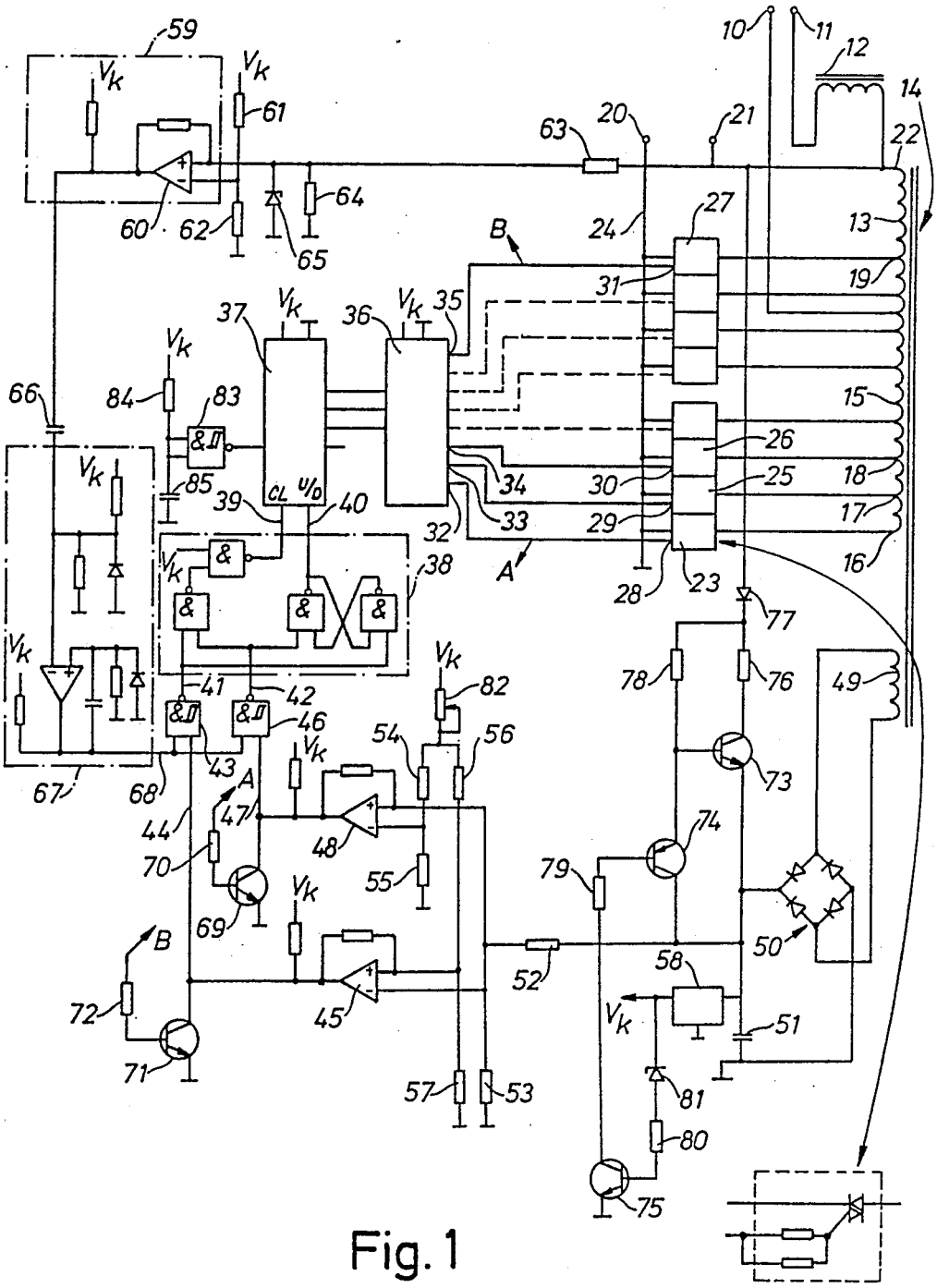
FIG. 1 shows a circuit diagram for a voltage control arrangement.

In controlling the voltage supplied to a fluorescent lamp, not shown, the voltage is supplied to the secondary winding 13 of an autotransformer 14 via terminals 10, 11 and a series-connected choke 12. The primary winding 15 of the transformer has a number of taps, the lowermost three of which in the diagram being designated 16, 17, 18 and the uppermost of which being designated 19. The tap 16 is the lowermost end of the primary winding. The number of taps is determined by the difference between the highest and the lowest of the system voltages used and of the size of the voltage appearing between two taps and which constitutes the desired step of control voltage. This step has been chosen such that when variations in the input voltage to the transformer occur the voltage on the fluorescent lamp will never vary more than 10% from the predetermined value, in the example 110 V.

The transformer 14 is connected to an A.C. mains via terminals 20, 21. The terminal 20 is connected to the zero reference level of the circuit, herein referred to as ground. The connection to ground of the components are indicated in the circuit diagram but will not regularly be commented on in the following description. The upper end 22 of the transformer, being common to the primary and the secondary windings, is connected to the terminal 21 while the opposite end 16 of the primary winding via an electronic switch 23 is connected to a conductor 24 which in turn is connected to the terminal 20. In the example the electronic switch is a triac but the use of circuits including anti-parallel thyristors is of course possible. Correspondingly, the taps 17–19 are via electronic switches 24–27 connected to the conductor 24. The switches have control inputs 28, 29, 30, 31 connected to corresponding outputs 32, 33, 34, 35 of a decoder 36. The task of the decoder is to decode the count of a counter 37 and depending on the count to emit an output signal to one of the outputs to turn on the corresponding switch.

The operation of the counter 37 is controlled by a flip-flop 38 having an output 39 connected to the clock input CL of the counter and an additional output 40 connected to an input of the counter called U/D. This input is used to effect the counting up and down, respectively, of the counter. The flip-flop 38 has two control inputs 41, 42. The input 41 is connected to the output of an inverting AND-gate 43 one input of which via a conductur 44 being connected to the output of a comparator 45 intended for emitting an output signal effecting count down of the counter. Correspondingly, the input 42 is connected to an AND-gate 46 of the same type as the gate 43. Via a conductor 47 one input of this gate is connected to the output of a comparator 48 arranged to emit an output signal for counting up of the counter.

To the PLUS-input of the comparator 48 and the MINUS-input of the comparator 45 a D.C. voltage is supplied which represents the voltage of the mains. This D.C. voltage is taken from a sensing winding 49 of the transformer. The A.C. voltage appearing across the sensing winding is rectified in a rectifier bridge 50 and smoothed in the usual way by a capacitor 51. A suitable level of the voltage is achieved via a voltage divider comprising two resistors 52, 53.

In the comparators 45, 48 the D.C. voltage corresponding to the mains A.C. voltage is compared with an upper and a lower reference level, respectively. The two reference levels determine a range that corresponds to the allowable variation of the mains A.C. voltage.

The upper reference level is applied to the MINUS-input of the comparator 48 and is formed by a voltage divider connected to a constant voltage $V_k$ and comprising an adjustable resistor 82 connected in series with two resistors 54, 55. The lower reference level is applied to the PLUS-input of the comparator 45 and, correspondingly, this level is formed by a voltage divider comprising the adjustable resistor 82 and two additional resistors 56, 57. The constant voltage $V_k$ is the voltage across the capacitor 51 which has been stabilized in a circuit 58. The voltage $V_k$ is also utilized for the supply of the electronic components included in the voltage control arrangement.

For the control of the counter 37 clock pulses are required which are synchronized with the frequency of the mains voltage. This is caused by the fact that the triac switches 23, 25, 26, 27 must be turned to non-conducting state at the moment the current is zero. In this application where the load of the triac switches is mainly inductive a phase-shift between the current and the voltage will be obtained which is about 90°. In the stepwise switching between the taps between the primary winding any disruption in the current flowing in the winding is not wanted but the switching between the two triac switches should be as continuous as possible. Accordingly, a triac should turn on simultaneously with the turning off of the triac already turned on. As stated above a triac is turned off when the current passes zero and, accordingly, the switching should take place at this time. However, at this time the voltage is at a maximum which could lead to the triac being retriggered and damaged. Therefore, a protective circuit, a so-called snubber, is provided which eliminates the effect of the high switching voltage.

In order to eliminate the need for protective circuits for the triac switches the switching can be performed such that a triac is turned on shortly before the turning off of the conducting triac. This means that during a short time both triacs are conducting and the part of the primary winding interconnecting the triacs will be short-circuited. This short-circuiting causes such a high current that the phase-shift will practically cease and, hence, the current and the voltage will be in phase. Therefore, the switching can be related to the moment the voltage crosses zero which reduces the losses. From a practical point of view the switching is chosen to be as close as possible to the zero-crossing of the voltage but so that the two triacs concerned will be simultaneously conducting for a moment.

With reference to the above the clock pulses should have a frequency coinciding with the frequency of the mains. At the same time, however, the pulses should be displaced as to time relative to the zero crossings of the A.C. voltage so as to be slightly leading. To this end there is provided a zero-crossing detector 59 of the so-called offset type which means that detecting takes place not at the zero-crossing but at a time of 0.5–1 ms before. The detector consists of a comparator 60 to the MINUS-input of which a reference voltage is supplied which is generated by means of a voltage divider comprising two resistors 61, 62 and connected to the voltage $V_k$. To the PLUS-input of the comparator an A.C. voltage is applied which is derived from the mains voltage the amplitude of which, however, being limited to a few volts by means of a voltage divider comprising to resistors 63, 64 and a zener diode 65 connected in parallel with the resistor 64.

The output of the detector 59 is via a capacitor 66 connected to the control input of a monostable multivibrator 67 the conventional design of which is not described herein in detail. Via a conductor 68 the output of the multivibrator 67 is connected to the remaining inputs of the AND-gates 43 and 46, respectively. The clock pulses referred to above are emitted by the monostable multivibrator 67 and these are used for the transmission of the signals on conductors 44 or 47 from the comparators 45 and 46, respectively, to the counter 37 causing it to count up or down.

The counting range of the counter is limited both upwards and downwards for the counter to remain in the count position corresponding to the highest and the lowest value, respectively, of the mains voltage within the control range even if the mains voltage considered should go above or below the range limits.

To this end the base of a transistor 69 is connected via a resistor 70 to the output 32 of the decoder 36 the collector of the transistor being connected to the output of the comparator 48. Moreover, the base of an additional transistor 71 via a resistor 72 is connected to the output 35 of the decoder the collector of the transistor being connected to the output of the comparator 45. If the mains voltage should be higher than the highest limit value the output of the comparator 48 will have a high level at the same time as the output 32 has a high level. Therefore, the transistor 69 will conduct applying a low level to the conductor 47. In the same way if the mains voltage should go below the lower limit of the control range the transistor 71 will apply a low level to conductor 44.

As already described the power for the electronic components is obtained from the voltage stabilizing circuit 58. Since the circuit is supplied from the winding 49, when the mains voltage is turned on the circuit will not supply any voltage to the output due to the fact that no triac switch has yet been activated. Therefore, in order for voltage to be supplied during start a starting circuit is provided which comprises three transistors 73, 74, 75. The collector of the transistor 73 is connected to the terminal 21 via a resistor 76 and a diod 77. The emitter of the transistor 74 is connected to the base of the transistor 73 which via a resistor 78 is connected to the connecting point between the diod 77 and the resistor 76. Via a resistor 79 the base of the transistor 74 is connected to the collector of the transistor 75. The emitter of this transistor is connected to ground while its base via a resistor 80 and a zener diode 81 is connected to the output of the circuit 58. The emitter of the transistor 73 as well as the collector of the transistor 74 are connected to the input of the circuit 58.

Figure 2:
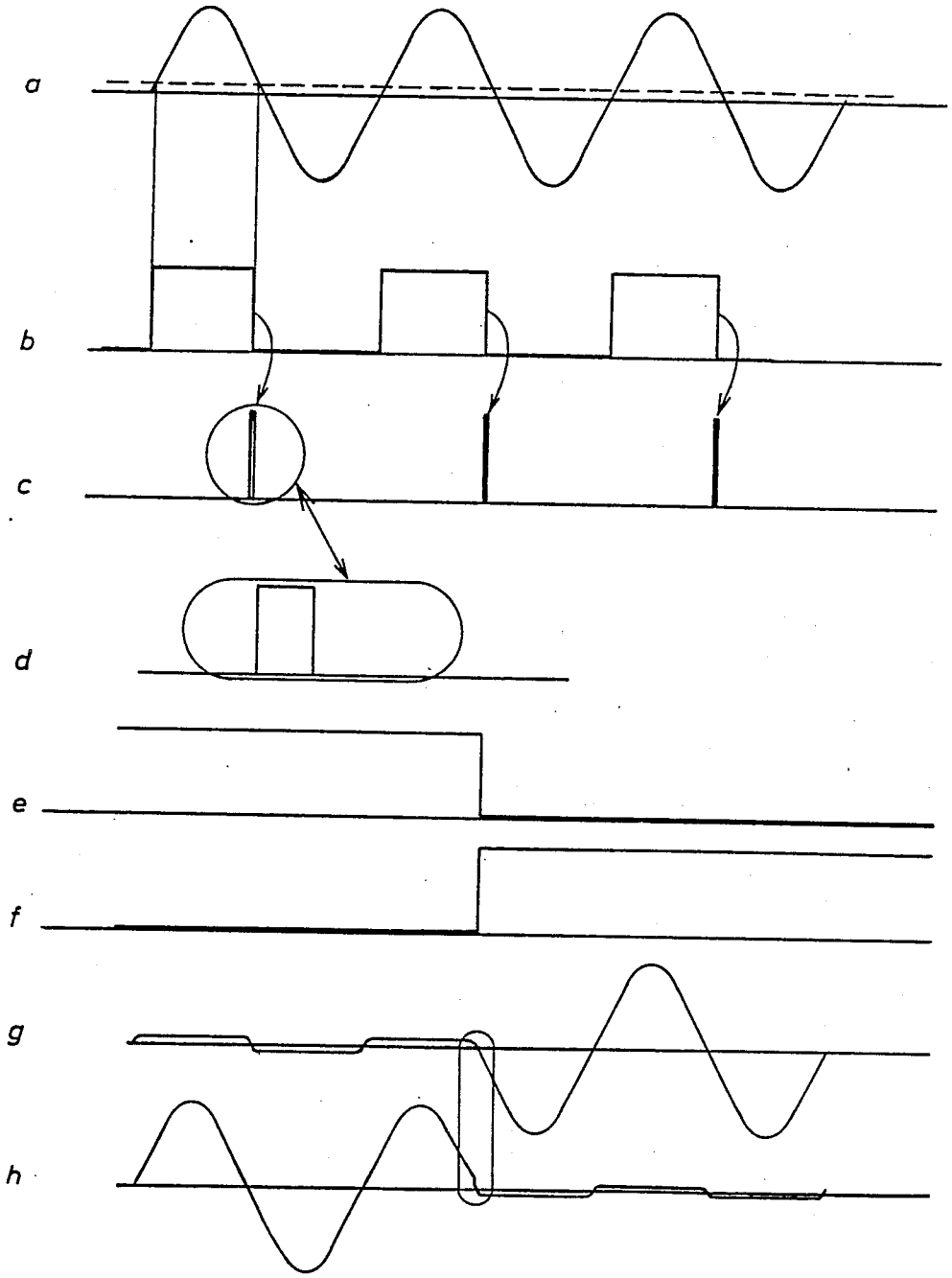
FIG. 2 shows a pulse diagram for the circuit according to FIG. 1.

The function of the voltage controlling arrangement will now be described with reference also to the pulse diagram of FIG. 2.

When turning on the mains voltage to the terminals 20, 21 the transistor 73 will receive base current which causes the transistor to start conducting. Then, the capacitor 51 starts charging and as the capacitor voltage grows the output voltage $V_k$ from the circuit, 58 will also rise and when this voltage exceeds about 3 V the active circuits being part of the coupling, will start operating. The counter 37 is designed to take a count activating the output 32 of the decoder 36. Then the triac 23 is operated to connect the tap 16 to the terminal 20 thereby connecting the whole primary winding. The automatic setting of the counter 37 takes place via an input connected to the output of an inverting AND-gate 83 the two inputs of which both via a resistor 84 being connected to the voltage $V_k$ and via a capacitor 85 to ground. Upon turning-on of the voltage the output of the gate is high causing the automatic setting of the counter. When the voltage at the input has exceeded a certain level a shift takes place and the output goes low releasing the counter to count up or down.

Since the tap 16 is connected a voltage will appear across the winding 49 causing the voltage on the capacitor 51 to further rise to a value corresponding to the present mains voltage. When the voltage $V_k$ equals about 8 V the zener diode 81 begins to conduct. Then also the transistors 74 and 75 start conducting with the result that the transistor 73 will be cut off. As a result the starting circuit will be switched off and the voltage across the capacitor 51 will be determined only by the voltage across the winding 49. Should the capacitor voltage have a magnitude within the interval determined by the upper reference level on the MINUS-input of comparator 48 and the lower reference level on the PLUS-input of comparator 45 none of the comparators will emit any output signal and, accordingly, the mains voltage has such a magnitude that the tap 16 and, hence, the whole primary winding should be connected to supply to the fluorescent lamp the correct voltage.

Now, if the present mains voltage is lower than what corresponds to the tap 16 of the primary winding to be connected, the voltage at the MINUS-input of the comparator 45 will go below the reference value and the output of the comparator will take a high level. As a result, the input of the AND-gate 43 connected to the comparator will also take a high level. Upon the clock pulse from the monostable multivibrator 67 appearing at the other input of the AND-gate 43, at the front edge of the pulse the output of the flip-flop 38 connected to the input 40 of the counter 37 will take a high level and at the back edge of the pulse the flip-flop will apply to the input 39 of the counter a positive pulse clocking-in the signal at the input 40 so that the counter will count down by one step. The output 32 of the decoder 36 will then go low while the output 33 goes high activating the triac 25 and connecting the tap 17 of the primary winding. As indicated above the triac 25 will be connected while the triac 23 is still conducting causing the part of the winding between the taps 16 and 17 to be short-circuited and changing the phase-shift between current and voltage in the winding part being short-circuited from about 90° to zero. At the immediately following zero-crossing for the voltage the triac 23 will open without any voltage transients to occurring.

The clock pulses from the monostable multivibrator 67 are generated in the following way. The mains voltage, as represented by the waveform in line a of FIG. 2, is applied to the zero-crossing detector 59. The range of interest of the mains voltage is where the voltage after having been at its positive maximum descends and approaches the zero-crossing. The shift level of the detector is chosen such that the rear flank of the pulses in the pulse train from the detector, line b in FIG. 2, to some extent precedes the zero-crossing of the mains voltage. This rear flank triggers the monostable multivibrator 67 the pulse response of which is to be found in line c and in magnified shape in line d in the figure. As already described the counter is clocked by the rear flank of the pulse from the monostable multivibrator. The level shift at the outputs 32 and 33 of the decoder is shown in lines e and f. The waveforms of the voltage across the triacs 23 and 25 are drawn in lines g and h. Straight below the shift flanks in lines e and f an area is marked in lines g and h showing the triac 25 to start conducting slightly before the triac 23 stops conducting at the immediately following zero-crossing.

If even after the switching-in of the tap 17 of the primary winding the voltage on the MINUS-input of the comparator 45 should be below the reference level the same procedure again takes place and the counter counts down one further step connecting the tap 18. The procedure continues up to the connecting of the tap which supplies the correct voltage to the fluorescent lamp.

If in operation the mains voltage should decrease, a similar control procedure will be initiated with the difference that now the comparator 48 will be activated for operating the counter to count up. In this case, via the AND-gate 46 the signal on the conductor 47 will be clocked into the counter in the way described.

The time required for the control arrangement to apply to the load the correct voltage amounts to a few periods of the A.C. voltage supplied. This means that in case the load is a fluorescent lamp of the kind indicated the lamp will have received the correct voltage long before the time at which the lamp is lit (turn-on time 1–2 seconds).

I claim:

1. In an arrangement for controlling on A.C. voltage for supplying a load wherein the load is connected to the secondary winding of a transformer, the primary winding of the transformer has a number of taps which are selectively connectable to an external A.C. voltage source, an electronic control device is responsive to the magnitude of the terminal voltage of the external A.C. voltage source for stepwise connecting the different taps automatically to thereby connect that tap which causes the voltage supplied to the load to be of a predetermined value, the electronic control device comprising controllable two-way electronic switches, the number of which corresponds to the number of said taps, the improvement wherein the electronic control device further comprises means connected to control the operation of the electronic control device so as to close the switch to be activated next before the switch then conducting is opened whereby the last two mentioned switches are only momentarily closed at the same time to short circuit a portion of the secondary winding and the phase shift between the voltage and current therein is momentarily eliminated.

2. Arrangement according to claim 1, wherein the electronic control device further comprises a counter with a decoder having control outputs, the number of which corresponds to the number of said switches, the transformer having a separate winding from which a D.C. voltage is derived which represents the present value of the terminal voltage, the D.C. voltage applied to a comparing device having two outputs, depending on the value of the D.C. voltage relative to an upper and a lower reference level, respectively, whereby signals are emitted on the said outputs causing the counter to count up or down for activating a tap of higher or lower terminal voltage adjacent to the tap then connected, the electronic control device further comprising means for generating a control signal which cooperates with the output signals from the comparing device to control the operation of the counter, so as to close the switch to be activated next before the switch then conducting is opened.

3. Arrangement according to claim 2, wherein the electronic control device further comprises a zero-crossing detector for the exterior A.C. voltage source, the detector comprising a comparator wherein an output level shift of the comparator takes place during the positive half-period of the A.C. voltage at a level of the A.C. voltage which is displaced by 0.5–1 ms from the times of the zero-crossings, said control signal cooperating with the output signal of the comparator.

4. Arrangement according to claim 2 or 3, further comprising means for supplying the electronic control device with a voltage derived from a separate winding of the transformer and also from an electronic starting circuit connected in parallel with the transformer, said electronic starting circuit being operative only while starting said arrangement.

* * * * *